United States Patent [19]

Deutsch et al.

[11] Patent Number: 4,570,520

[45] Date of Patent: Feb. 18, 1986

[54] TONE GENERATOR ASSIGNMENT IN A KEYBOARD ELECTRONIC MUSICAL INSTRUMENT

[75] Inventors: Ralph Deutsch, Sherman Oaks; Leslie J. Deutsch, Sepulveda, both of Calif.

[73] Assignee: Kawai Musical Instruments Mfg. Co., Ltd., Hamamatsu, Japan

[21] Appl. No.: 591,353

[22] Filed: Mar. 19, 1984

[51] Int. Cl.[4] ..... G10H 1/22; G10H 7/00

[52] U.S. Cl. ..... 84/1.01; 84/DIG. 2; 340/365 S

[58] Field of Search ..... 84/1.01, DIG. 2; 340/365 S

[56] References Cited

U.S. PATENT DOCUMENTS

| | | | |
|---|---|---|---|
| 4,335,639 | 6/1982 | Okamoto | 84/1.01 |
| 4,357,849 | 11/1982 | Ezawa et al. | 84/1.01 |
| 4,481,851 | 11/1984 | Swain et al. | 84/1.01 |

*Primary Examiner*—Stanley J. Witkowski

*Attorney, Agent, or Firm*—Ralph Deutsch

[57] ABSTRACT

A keyboard operated electronic musical instrument is disclosed wherein the number of tone generators is less than the number of keyswitches in a keyboard array of keyswitches. If all the available tone generators have been assigned to actuated keyswitches, the actuation of an additional keyswitch causes the oldest tone generator to be assigned to the newest keyswitch. The assignment action does not depend upon the release of any keyswitch. A phase addition means is used to remove the oldest tone generator so that release key clicks are not generated.

12 Claims, 9 Drawing Figures

TONE GENERATOR ASSIGNMENT IN A KEYBOARD ELECTRONIC MUSICAL INSTRUMENT

BACKGROUND OF THE INVENTION

1. Field of the Invention

This invention relates to electronic music synthesis and in particular is concerned with the assignment of a limited number of tone generators to actuated keyboard switches.

2. Description of the Prior Art

The current trend to use microelectronic implemented tone generators for keyboard operated musical instruments has led to the development of systems which achieve a measure of economy by using a plurality of tone generators which is less in number than the number of keyboard switches in the keyboard array of keyswitches. An assignment logic is implemented to assign the members of the available tone generators to keyswitches as they are depressed to their actuated keyswitch states. An inevitable resource availability problem arises when all the tone generators have been assigned to keyswitches and an additional keyswitch is actuated.

There have been several assignment systems implemented to cope with the resource availability problem. One of the earliest assignment systems was disclosed in U.S. Pat. No. 2,577,493 entitled "Electronic Musical Instrument." In the disclosed system a number of analog oscillators are assigned by means of a multicontact set of keyswitch contacts to actuated keyswitches. The assignment action also introduces a preselected capacitor so that the assigned oscillator generates a signal whose fundamental frequency corresponds to the assigned actuated keyswitch. The assignment system disclosed in the reference patent does not teach any means to cope with the situation in which all the tone generators have been assigned and an additional keyswitch is actuated.

Because there are ten fingers available to the musician, it would seem at first thought that ten tone generators would suffice for any one keyboard. Modern keyboard instruments have incorporated a tone effect that demands more than one tone generator to be assigned to action of a single finger. This tone effect is given the generic name of "sustain." Unfortunately this term has led to some confusion because the present usage of envelope modulation is to refer to an ADSR (attack-/decay/sustain/release) time envelope modulation function. More properly the older term of "sustain" should now be called "long release." With a long release, it is a fairly easy matter to release a keyswitch and actuate another keyswitch with a single finger while the first tone generator is still operative and is automatically being reduced in tone volume by its ADSR envelope modulation function.

A tone generator assignment system intended to accommodate the resource availability problem when a long release mode has been implemented for a specified keyboard is described in U.S. Pat. No. 3,610,806 entitled "Adaptive Sustain System For Digital Electronic Organ." In the disclosed system the tone generators follow the normal sequence of assignment of attack, decay, and release as long as an unassigned tone generator is idle and is available for assignment. When all the tone generators have been assigned, the system automatically enters an adaptive sustain mode in which any tone generator assigned to a note associated with a key on the manual having a long release effect, and which generator is supplying the waveform that has the longest duration of its envelope modulation release phase, is switched immediately from a long release to a relatively shorter release while still employing exactly the same predetermined envelope modulation function.

A problem that is inherent with tone generator assignment logic systems is that they are not ideal in the sense that fairly common musical systems arise in which the assignment logic operates in a manner which is contrary to that expected by the musician.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted into musical waveshapes. Following each individual computation cycle, a transfer cycle is initiated during which the stored master data set is transferred to an associated one of a plurality of note registers. There is a note register associated with each one of the tone generators. The tone generators are assigned to actuated keyboard switches.

The data stored in the note register corresponding to a tone generator are read out sequentially and repetitively at a memory advance rate corresponding to the fundamental frequency of the musical note associated with the actuated keyboard switch.

Until all the available tone generators have been assigned the tone generator assignment subsystem operates in a normal fashion of assigning a tone generator to any actuated keyboard switch. If all the tone generators have been assigned and an additional keyboard switch is actuated, the assignment system enters a kill operation mode during which the oldest assigned tone generator is brought to a zero tone output state at the same time that this tone generator is assigned to the latest actuated keyboard switch. This kill mode is automatic and does not depend upon the release of any previously actuated keyboard switch. The tone reduction is accomplished by a phase cancellation process during which each data point for the master data set for the oldest assigned tone generator is brought to a small constant value.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed toward the tone generator assignment in a polyphonic tone generator to prevent the loss of tone when all the available tone generators have been assigned and a new keyboard switch is actuated. The tone generator assignment system is incorporated into a musical instrument of the type which synthesizes musical waveshapes by implementing a discrete Fourier transform algorithm. A tone generation system of this variety is described in detail in U.S. Pat. No. 4,085,644 entitled "Polyphonic Tone Synthesizer." This patent is hereby incorporated by reference. In the following description all elements of the system which are described in the reference patent are identified by two digit numbers which correspond to the same numbered elements appearing in the referenced patent. System element blocks which are identified by three digit numbers correspond to system elements added to the Polyphonic Tone Synthesizer or correspond to combinations of several elements appearing in the referenced patent.

Figure 1:
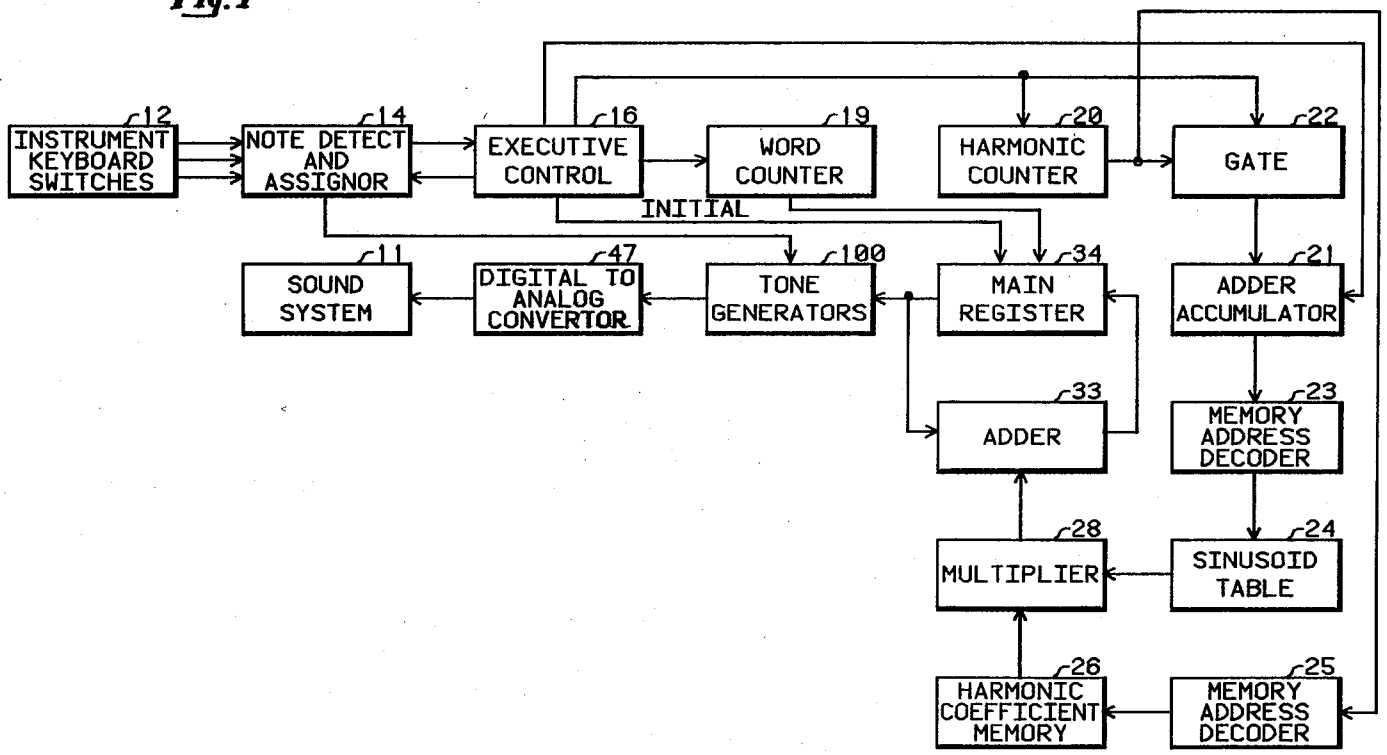
FIG. 1 is a schematic diagram of an embodiment of the invention.

FIG. 1 illustrates an embodiment of the present invention which is described as a modification and adjunct to the system described in U.S. Pat. No. 4,085,644. As described in the referenced patent, the Polyphonic Tone Synthesizer includes an array of keyboard switches 12. If one or more of the keyboard switches has a switch status change and is actuated ("on" switch position), the note detect and assignor 14 encodes the detected keyboard switch having the status change to an actuated state and stores the corresponding note information for the actuated keyswitches. One member of the set of tone generators, contained in the system block labeled tone generators 100, is assigned to each actuated keyswitch using the information generated by the note detect and assignor 14.

A suitable note detect and assignor subsystem is described in U.S. Pat. No. 4,022,098 which is hereby incorporated by reference.

When one or more keyswitches have been actuated, the executive control initiates a repetitive sequence of computation cycles. During each computation cycle a master data set comprising 64 data words is computed and stored in the main register 34. The 64 data words in a master data set correspond to the amplitudes of 64 equally spaced points of one cycle of the audio waveform for the musical tone produced by a corresponding one of the tone generators contained in the system block labeled tone generators 100. The general rule is that the maximum number of harmonics in the audio tone spectra is no more than one-half of the number of data points in one complete waveshape period. Therefore, a master data set comprising 64 data words corresponds to a maximum of 32 harmonics.

As described in the referenced U.S. Pat. No. 4,085,644 it is desirable to be able to continuously recompute and store the generated master data set during a repetitive sequence of computation cycles and to load this data in the note registers associated with the tone generators while the actuated keys remain actuated, or depressed, on the keyboards.

In the manner described in the referenced U.S. Pat. No. 4,085,644 the harmonic counter 20 is initialized to its minimal, or zero, count state at the start of each computation cycle. Each time that the word counter 19 is incremented by the executive control 16 so that it returns to its initial, or minimal, count state because of its modulo counting implementation, a signal is generated by the executive control 16 which increments the count state of the harmonic counter 20. The word counter 19 is implemented to count modulo 64 which is the number of data words in the master data set. The harmonic counter 20 is implemented to count modulo 32. This number corresponds to the maximum number of harmonics consistent with a master data set comprising 64 data words.

At the start of each computation cycle, the accumulator in the adder-accumulator 21 is initialized to a zero value by the executive control 16. Each time that the word counter 19 is incremented, the adder-accumulator 21 adds the current state of the harmonic counter 20 to the sum contained in the accumulator. This addition is implemented to be modulo 64.

This content of the accumulator in the adder-accumulator 21 is used by the memory address decoder 23 to access trigonometric sinusoid values from the sinusoid table 24. The sinusoid table 24 is advantageously implemented as a read only memory storing values of the trigonometric function sin $(2\pi\theta/64)$ for $0 \leqq \theta \leqq 64$ at intervals of D. D is a table resolution constant.

The multiplier 28 multiplies the trigonometric value read out of the sinusoid table 24 by a harmonic coefficient read out from the harmonic coefficient memory 26. The memory address decoder 25 reads out harmonic coefficients from the harmonic coefficient memory 26 in response to the count state of the harmonic counter 20. The product value formed by the multiplier 28 is furnished as one input to the adder 33.

The contents of the main register 34 are initialized to a zero value at the start of a computation cycle. Each time that the word counter 19 is incremented, the content of the main register 34 at an address corresponding to the count state of the word counter 19 is read out and furnished as an input to the adder 33. The sum of the inputs to the adder 33 are stored in the main register 34 at a memory location equal, or corresponding, to the count state of the word counter 19. After the word counter 19 has been cycled for 32 complete cycles of 64 counts, the main register 34 will contain the master data set.

Following each computation cycle in the repetitive sequence of computation cycles a transfer cycle is initiated and executed. During a transfer cycle, in a manner similar to that described in the referenced U.S. Pat. No. 4,085,644, the master data set data is transferred from the main register 34 to a note register associated with a tone generator. The master data set stored in a note register is read out sequentially and repetitively at a memory advance rate determined by an associated note clock. The read out data values are converted to analog signals by means of the digital-to-analog converter 47 and furnished to the sound system 11. The sound system 11 comprises a conventional amplifier and speaker combination arrangement.

Figure 2:
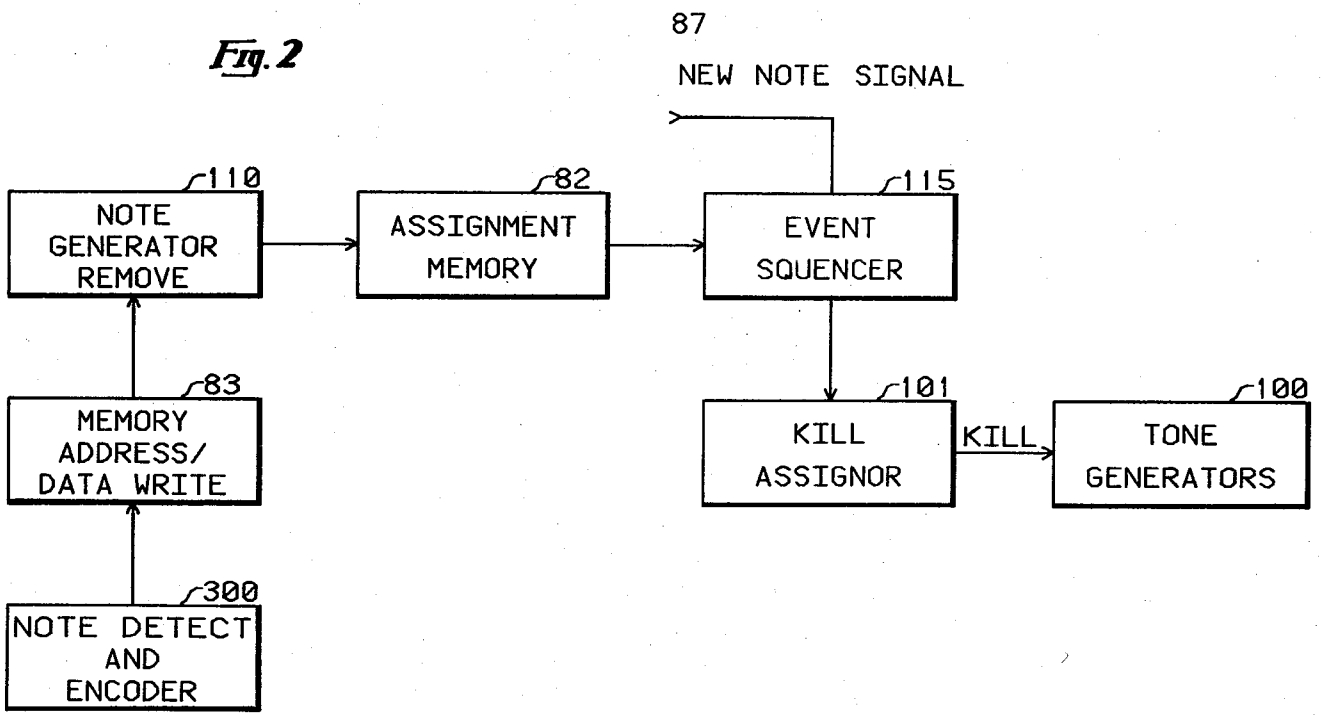
FIG. 2 is a schematic diagram of the note detect and assignor 14.

FIG. 2 illustrates logic added to the keyboard switch detect and assignor 14 described in the referenced U.S. Pat. No. 4,022,098. The blocks with two digit labels correspond to the like numbered blocks in the referenced patent. The note detect and encoder 300 contains the subsystem logic which detects keyswitch status changes and encodes newly actuated keyswitches in an assignment word containing the assigned status, keyboard number, octave number, and note number within an octave. The encoded assignment word is stored in the assignment memory 82 in response to data furnished by the memory address/data write 83.

As assignment data words are read out of the assignment memory 82 in response to the address data provided by the memory address/data write 83, the event sequencer 115 places the assignment data in a time ordered sequence corresponding to the time sequence in which the assignment data words have been assigned to actuated keyswitches. This sequence provides instant access to the oldest assignment data word corresponding to the oldest actuated keyswitch. Each assignment data word corresponds to a corresponding tone generator contained in the system logic block labeled tone generators 100. The detailed description of the operation of the event sequencer is given below.

The event sequencer 115 stores the assignment data words read out of the assignment memory 82 in a memory arrangement which is sequenced by the time history in which the assignment data words have been assigned in response to the actuation of the keyswitches contained in the system block labeled instrument keyboard switches 12. Time is counted from the instant in which the assignment data word is encoded into an assigned status. If all the tone generators have been assigned and if an additional keyswitch is actuated, a KILL signal is generated. In response to the generation of the KILL signal, the assignment data wod corresponding to the oldest assigned tone generator is made available to the tone generators 100 for assignment to the latest additional keyswitch. When the KILL signal is generated, the tone generator corresponding to the oldest assignment data word is rapidly brought to a zero sound output state. This action occurs even if the corresponding keyswitch remains depressed in its actuated keyswitch state. Moreover, the corresponding note cannot be replayed until the keyswitch is first released and then reactuated.

Figure 3:
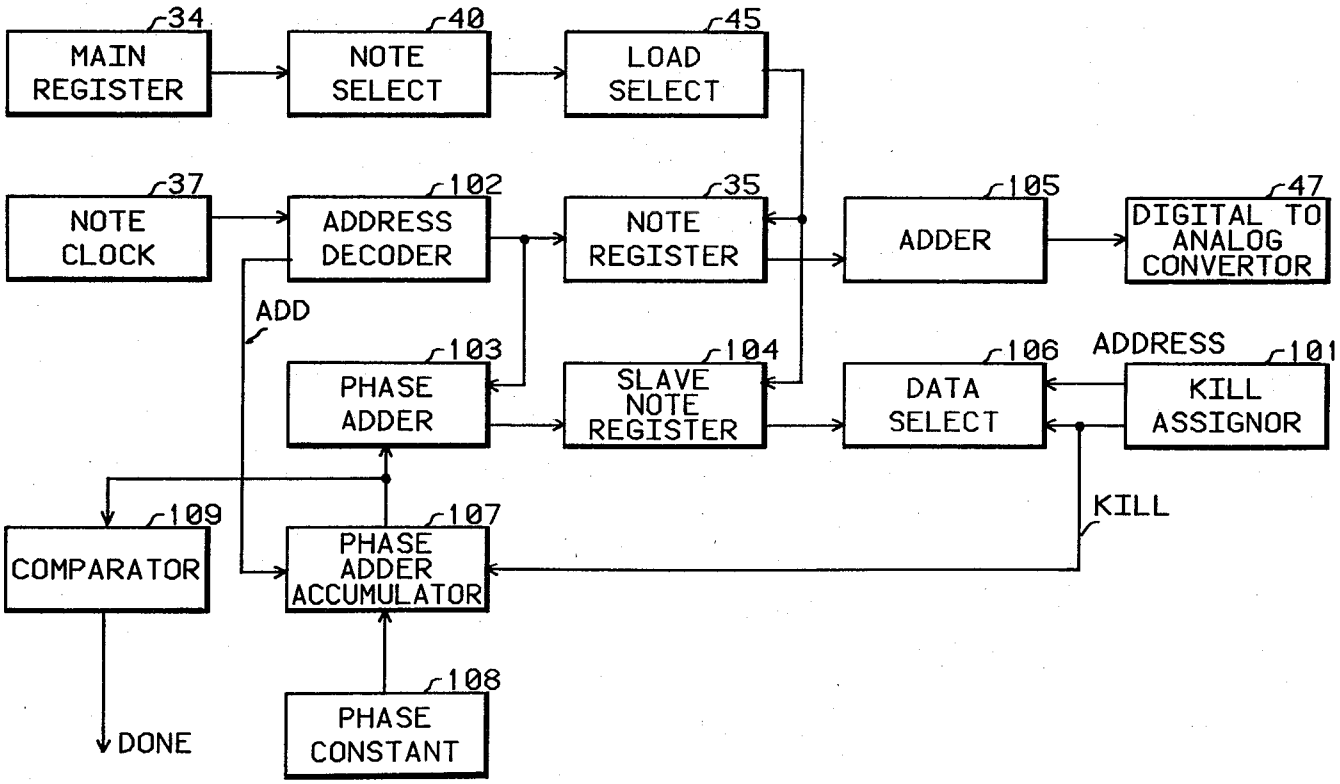
FIG. 3 is a schematic diagram of the tone level reduction system.

FIG. 3 illustrates a method of reducing the tone output from a selected tone generator in response to the KILL signal. The reduction in tone volume is accomplished by the pointwise addition of two identical waveshapes which are out of phase with respect to each other. The phase difference between the two waveshapes is varied until a complete waveshape cancellation is attained. When the complete state of cancellation is attained, in essence the tone generator ceases to function to produce an output tone. In this manner a "key click" produced by a sudden cessation of tone is avoided.

The master data set is computed in the fashion previously described and is stored in the main register 34. During the transfer cycle the master data set is transferred into the note register 35 and into the slave note register 104. Each tone generator comprises both a note register and a slave note register. FIG. 3 explicitly shows the logic for a single tone generator. It is understood that this logic is also duplicated for each of the other tone generators.

The master data set is read out of the note register 35 at a memory advance rate determined by the frequency of the associated note clock 37. The memory address decoder 102 addresses out master data words in response to the timing information provided by the note clock 37.

If the KILL signal is not present, then the data select 106 does not transfer any of the data words read out of the slave note register 104 to the adder 105, or to any similar adder associated with each of the other tone generators.

The address decoder 102 generates an ADD signal each time that the generated address changes from its maximum decimal value of 64 (binary logic state 63) to its minimal decimal value of 1 (binary logic state zero). In this fashion the ADD signal is generated each time that the first master data set word in the stored master set is addressed out from the note register 35.

In response to the KILL signal, the content of the accumulator is the phase adder accumulator 107 is reset to a zero initial value. Each time that the ADD signal is generated by the address decoder 102, the phase adder accumulator adds the phase constant furnished by the phase constant generator 108 to the contents of its accumulator. The phase constant generator 108 can be implemented as a read-only-memory containing a preselected constant number.

The phase adder 103 generates a memory address number which is equal to the address created by the address decoder 102 added with an offset number which is the current value of the content of the phase accumulator 107.

If when the KILL signal is generated, the tone generator explicitly shown in FIG. 3 is the oldest assigned tone generator, then data select 106 will transfer the master data set words read out from the slave note register 104 to the adder 105. Adder 105 pointwise sums the master data words read out from the note register 35 with the master data set words transferred by means of the data select 106. The net result is that the input data to the digital-to-analog converter 47 consists of the summation of two out-of-phase identical waveshapes. This produces a diminution of the maximum amplitude of the resultant waveshape from that that would have been produced if only the master data set words read out of the note register 35 were transferred unaltered to the digital-to-analog converter 47.

When the value contained in the accumulator of the phase adder accumulator 107 is equal to, or greater than, one-half of the number of master data set points which define a complete period of the waveshape of the musical tone, then a complete or nearly complete cancellation of the two component waveshapes occurs and essentially only zero data values are produced on the output of the adder 105. At this time a DONE signal is created and sent to the note detect and assignor 14.

The DONE signal is created by the comparator 109 when the output of the phase adder accumulator first reaches or first exceeds one-half of the number of data points in the master data set which specifies a complete period of the musical waveshape.

Figure 4:
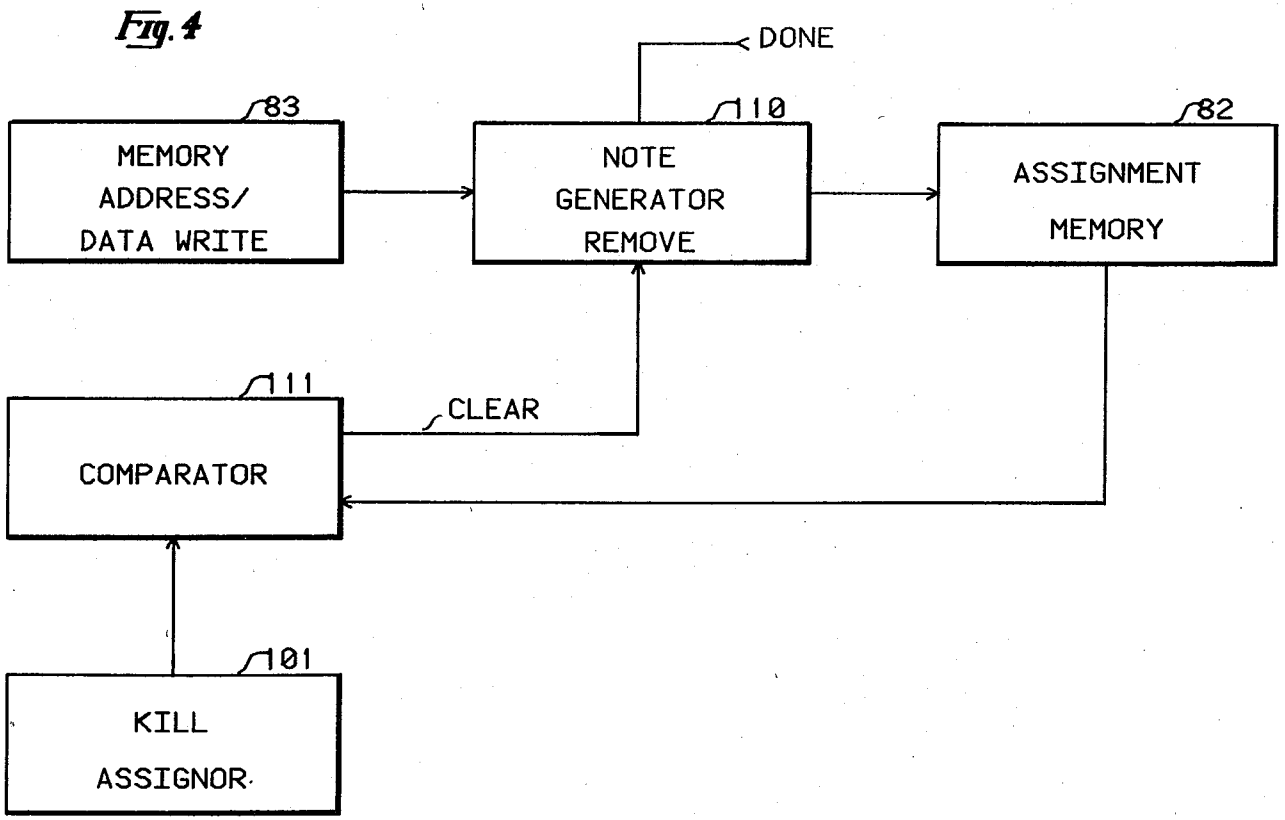
FIG. 4 is a schematic diagram of logic added to the note detect and assignor 14.

FIG. 4 shows system logic blocks added to those for the note detect and assignor 14 as described in the referenced U.S. Pat. No. 4,022,098. The purpose of the added logic is to place the oldest assigned tone generator in an unassigned status when the DONE signal is generated so that the newly actuated keyswitch can be immediately assigned to an available tone generator.

In the absence of the DONE signal, note generator remove 110 transfers assignment data words furnished by the memory address/data write 83 unaltered to the assignment memory 82. If the DONE signal is present (a binary "1" logic state), then in response to a CLEAR signal from the comparator 111, the note generator remove 110 will alter the input assignment data word so that it is encoded to indicate an unassigned status before it is stored in the assignment memory 82.

When the KILL signal is generated by the kill assignor 101, the assignment data word corresponding to the oldest assigned tone generator is furnished by the event sequencer 15 to the kill assignor 101. The kill assignor 101 in turn transfers this assignment data word to the comparator 111. The CLEAR signal is generated by the comparator 111 when the assignment data word provided by the kill assignor 101 is equal to the current assignment data word read out from the assignment memory 82.

As described in the referenced U.S. Pat. No. 4,022,098 the action of the note detect and assignor 14 is such that even if the oldest actuated keyswitch remains depressed, a tone generator assignment will not be made to the same keyswitch after the kill assignor 101 has placed the previously assigned tone generator in an unassigned state so that it can be assigned to a newly actuated keyswitch. This action is accomplished by the system response to the signals appearing on lines 86 and 87 as shown in FIG. 2 of U.S. Pat. No. 4,022,098. Signal 87 also appears in FIG. 2 of the present invention. In order to make a new assignment of a tone generator the signals on both lines 86 and 87 must be in the "1" binary logic state. Line 86 will have a "1" binary logic state if a keyswitch has been detected to have its switch state changed since the previous data scan of the keyboard. Line 87 has a "1" binary logic state if this keyswitch has changed from an unactuated state (key "off") to an actuated state and if an assignment data word has been read out of the assignment memory 82 which is encoded to indicate that an unassigned tone generator currently exists. If the oldest keyswitch remains depressed, then line 86 has a "0" binary state so that the assignment system would not attempt to reassign a tone generator to the oldest keyswitch.

Figure 5:
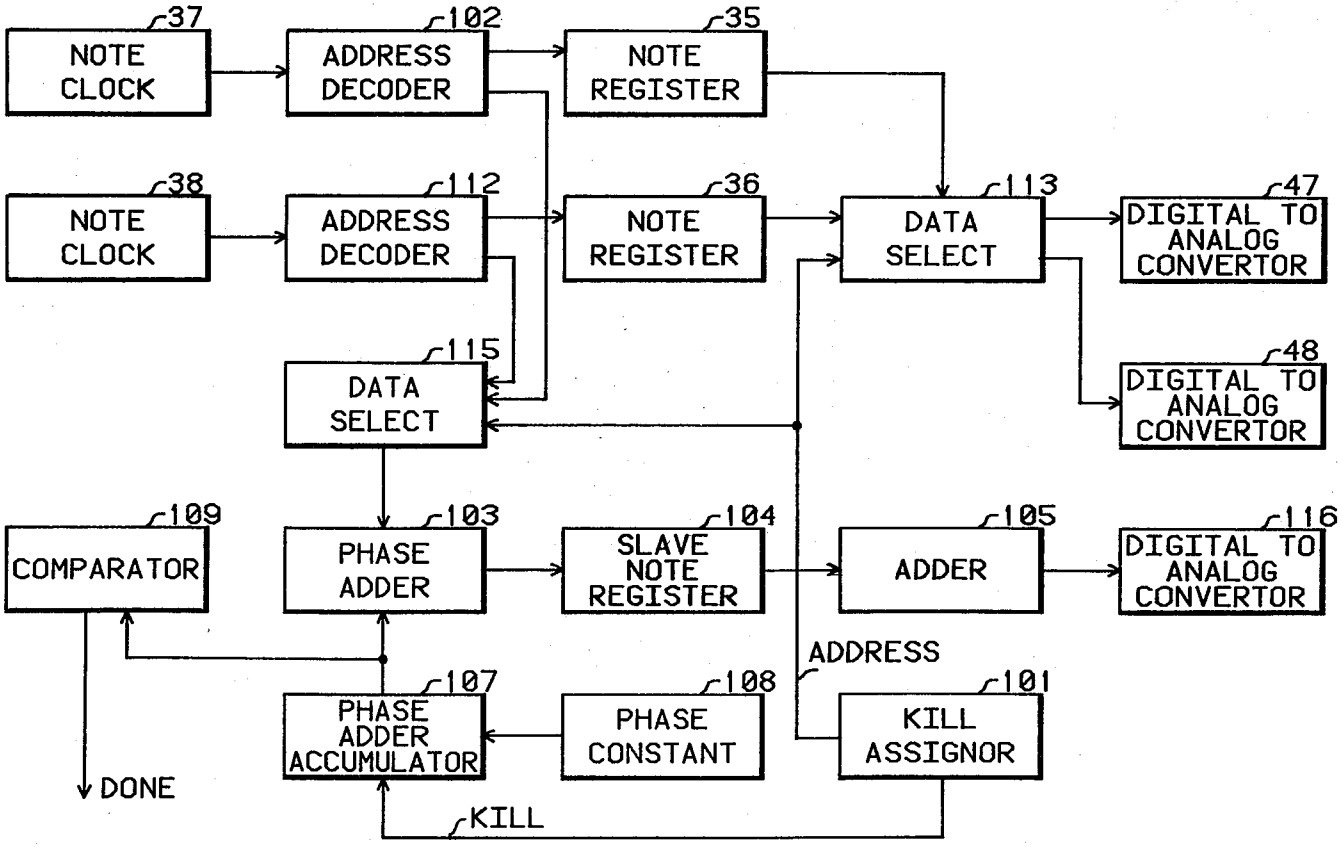
FIG. 5 is an alternate embodiment of the invention.

FIG. 5 shows an alternative embodiment for the present invention. In this alternative system arrangement only a single wave shape register is used to phase cancel any one of the set of tone generators 100 which has been designated to be released by the action of the kill assignor 101.

The ADDRESS signal furnished by the kill assignor 101 is used by the data select 115 to select either the output of the address decoder 102 or the address decoder 112 and furnish the selected address to the phase adder 103. While FIG. 5 explicitly shows two tone generators, it is apparent that the system can be readily extended to any desired number of tone generators. The ADDRESS signal from the kill assignor 101 is also used by the data select 113 to select master data set words read out of either note register 35 or note register 36 and furnish them to the adder 105. The master data set input to the data select 113 which are not selected to be transferred to the adder 105 are furnished to the digital-to-analog converters 47 and 48. If the KILL signal is not generated by the kill assignor 101, then data select 113 will act in a normal fashion to transfer the master data set read out of the note register 35 to the digital-to-analog converter 47 and to transfer the master data set read out of the note register 36 to the digital-to-analog converter 48.

The phased data read out of the slave register in response to the address data provided by the phase adder 103 is added to the selected note register data by means of the adder 105. The summed data is converted to an analog musical waveshape by means of the digital-to-analog converter 116.

It is noted that the removal of the oldest assigned tone generator in response to a new actuated keyswitch when all the available tone generators have been assigned is accomplished without any intervention or interaction with an ADSR. (attack/decay/sustain/-release) envelope modulation function generator. When the oldest assigned tone generator is reassigned to a new keyswitch in the fashion previously described, the tone generator is immediately assigned to the newly actuated keyswitch. At this time, the ADSR generator associated with the newly assigned tone generator simply starts a new attack phase without any regard to the ADSR envelope modulation phase that may have existed at the time the oldest assigned tone generator has been "killed" (made available for reassignment) and reassigned to the newly actuated keyswitch.

Figure 6:
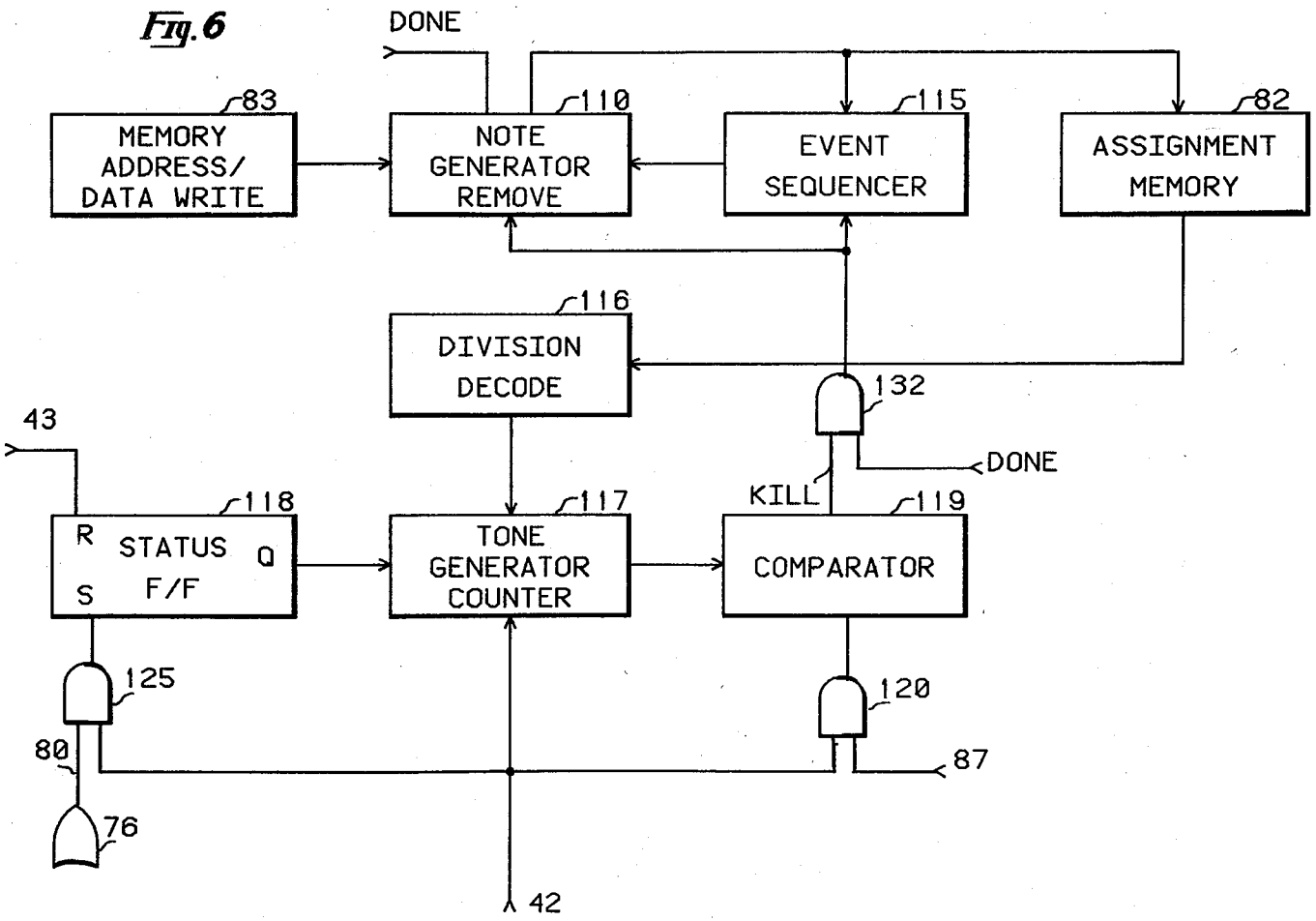
FIG. 6 is another alternate embodiment of the invention.

FIG. 6 illustrates another alternative embodiment of the invention. In this embodiment, the new assignment is made to a newly actuated keyswitch if all the available tone generators are currently assigned without first reducing the loudness of the oldest assigned tone generator. FIG. 6 illustrates the modification and added circuit logic blocks to the note detect and assignor 14 in the form described in the referenced U.S. Pat. No. 4,022,098.

As described in U.S. Pat. No. 4,022,098, and shown in FIG. 1 of the referenced patent, a "1" binary logic state is produced on line 80 by the OR-gate 76 if a keyboard switch has changed its switch state since the previous keyboard scan. If line 80 has "1" state and line 42 has a "1" state, then the status F/F 118 is set. Line 42 will have a "1" state if the upper keyboard division keyswitches are being scanned. While the explanation of the system operation is presented for a single keyboard, the extension of the system to a plurality of keyboards is simply a duplication of the same system logic functions.

When the status F/F 118 is set so that its output state is Q="1", the tone generator counter 117 is permitted to count signals provided by the division decode 116. The tone generator counter 117 is reset to a zero initial value when the signal on line 42 changes from a "0" binary logic state to a "1" binary logic state.

The division decode 116 decodes the assignment data words as they are read out of the assignment memory 82. If an assignment data word corresponds to a one for the upper division (corresponding to a "1" state on line 42), then a signal is sent to increment the count state of the tone generator counter 117.

If the signal on line 87 is in the "0" binary logic state, then no action is initiated by the assignment subsystem shown in FIG. 6. Line 87 will be binary logic state "1" if a keyswitch has been detected to have changed from an unactuated to an actuated keyswitch state. If line 87 is in a "1" binary logic state and if line 42 is in a "1" binary logic state, then AND-gate 120 generates a "1" logic signal which is furnished to the comparator 119.

If the tone generator counter 117 has been incremented to the maximum number of tone generators available to be assigned to the upper manual (corresponding to a signal on line 42) then in response to a "1" logic signal from AND-gate 120, the comparator 119 will generate a KILL signal. Comparator 119 creates the KILL signal by comparing the count state of the tone generator counter 117 with an internal stored number which is equal to the maximum number of tone generators available to be assigned to the upper manual. The KILL signal in its "1" binary logic state signifies that all the available tone generators have been assigned to the upper manual and a new keyswitch has been detected to have been actuated.

In response to the "1" logic state for the KILL signal, the event sequencer 115 furnishes the assignment data word for the oldest assigned tone generator for the upper manual to the note generator remove 110. The note generator remove 110 temporarily stores the assignment data word furnished by the event sequencer 115 in response to the KILL signal in a register. The next time that the memory address/data write 83 is furnished an assignment data word which is identical to the one stored in the note generator 110, its status bit is changed to an unassigned status before it is stored in the assignment memory 82 if the DONE signal has been generated. Therefore the next time the upper keyboard, or upper manual, is scanned a tone generator will be available to be assigned to the newly actuated keyswitch.

It is noted that the assignment system requires no modification to the ADSR envelope function generator. The newly assigned tone generator will automatically have its ADSR envelope function started in the normal attack phase.

As long as the oldest actuated keyswitch remains depressed in its actuated keyswitch state, no tone generator will be reassigned to it. This action has been previously described. Until this keyswitch is released and again depressed, no tone generator can be reassigned to this keyswitch.

Another alternative implementation to the present invention is to cause the ADSR generator to quickly release the oldest tone generator in response to the KILL signal. This action is accomplished by using the KILL signal to increase the speed in which the final, or release, phase is accomplished for the oldest assigned tone generator for the upper manual. The same concept is readily implemented for tone generators associated with any other manual. The KILL signal in combination with the identification of the oldest assigned tone generator is used to create a signal which is equivalent to that which would be produced by a release of the corresponding keyboard switch.

Figure 7:
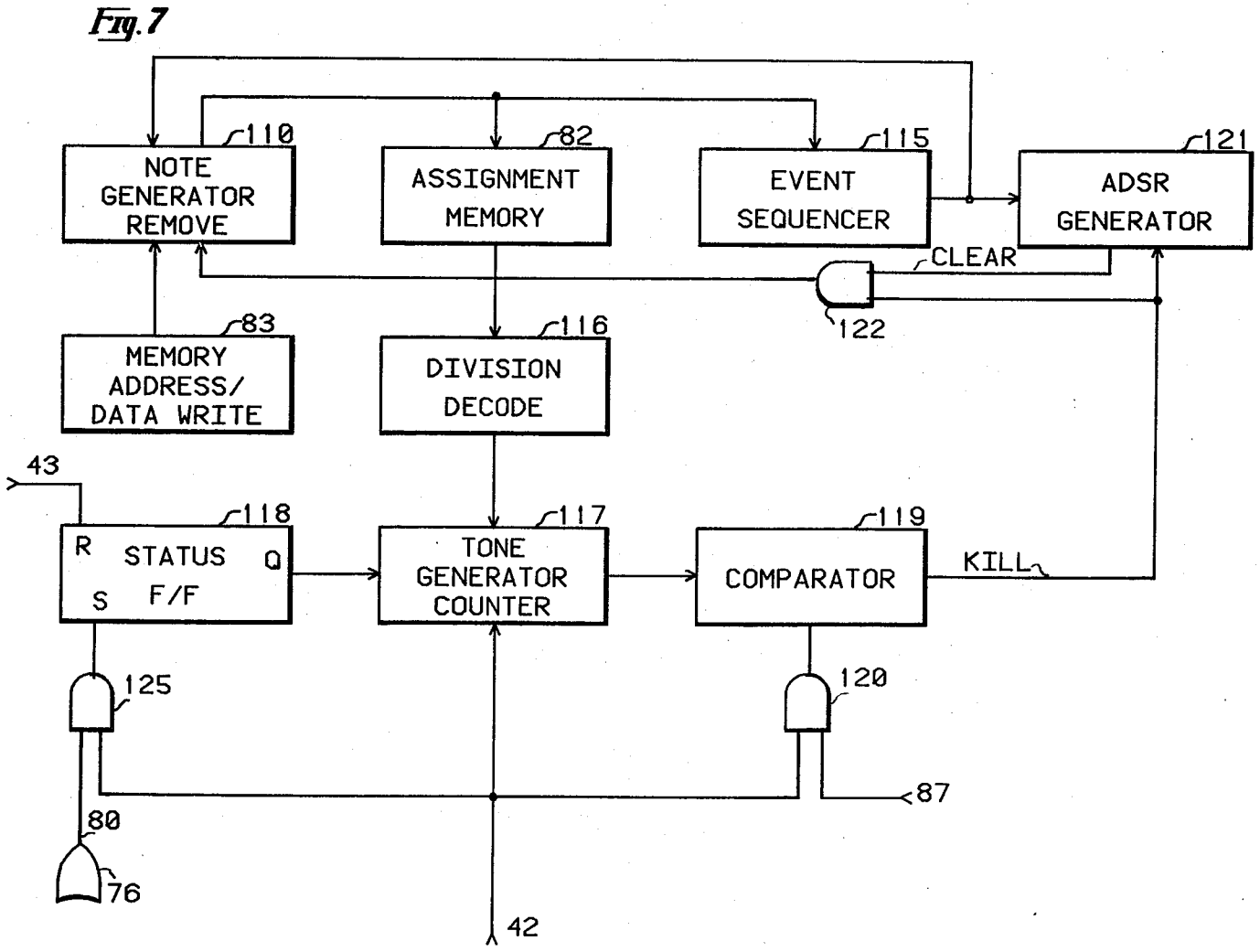
FIG. 7 is a schematic diagram of a combination of ADSR generator and note assignor.

FIG. 7 illustrates the system assignment logic for using the inventive assignment concept in conjunction with an ADSR generator shown in the system logic block labeled ADSR generator 121. A suitable implementation for the ADSR generator 121 is described in U.S. Pat. No. 4,075,650 entitled "ADSR Generator." This patent is hereby incorporated by reference.

If the tone generator counter 117 has been incremented to the number of tone generators available for assignment to the upper manual, then in response to a "1" binary logic state signal from the AND-gate 120, the comparator 119 will generate a KILL signal. The presence of the KILL signal signifies that all the available tone generators have been assigned to the upper manual and that a new keyswitch has been actuated.

In response to the KILL signal, the event sequencer 115 furnishes the assignment data word for the oldest assigned tone generator on the upper manual to the note generator remove 110 and to the ADSR generator 121. The note generator remove 110 temporarily stores the assignment data word furnished by event sequencer in response to the KILL signal.

In response to the KILL signal, the ADSR generator 121 immediately places the envelope generator corresponding to the assignment data word furnished by the event sequencer 115 into the release envelope modulation phase. If the ADSR generator corresponding to this assignment data word had previously been assigned a long release time then the release time is shortened. When this tone generator has had its ADSR envelope release phase completed a CLEAR signal is generated.

AND-gate 122 will generate a binary "1" logic state signal if both the KILL and the CLEAR signals have been generated. If the output from AND-gate 122 is a logic "1" state, then the next time that the memory address/data write 83 is furnished an assignment data word which is identical to the one that is stored in the note generator remove 110, then that data word is encoded to indicate an unassigned status and is stored in the assignment memory 82. In this fashion, the next time that the upper keyboard is scanned a tone generator will be available to be assigned to the newly actuated keyswitch.

Figure 8:
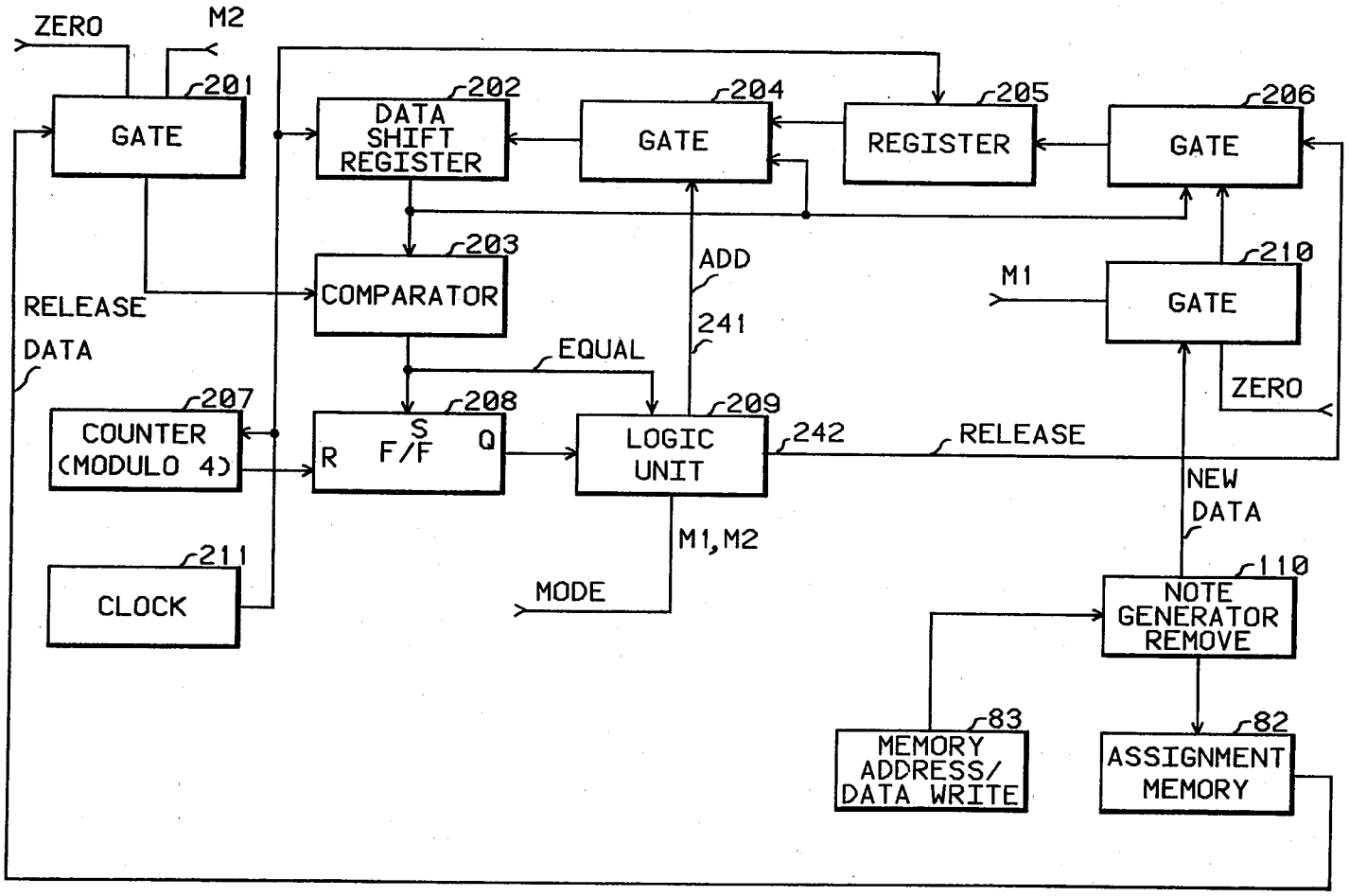
FIG. 8 is a schematic diagram of the event sequencer 115.

FIG. 8 shows the detailed logic of the event sequencer 115. For illustrative purposes the subsystem is described for the situation in which there are four tone generators available for assignment to the upper keyboard. This is not a limitation of the invention as an extension is readily made to any desired number of tone generators.

As a new assignment data word is addressed from the assignment memory 82 by means of a data word furnished by the memory address/data write 83, the new word is furnished as a input to the gate 210.

The MODE signal is composed of two bits, $m_1$ is the MSB (most significant bit) and $m_2$ is the LSB (least significant bit). The MODE signal has the following control states:

| $m_1$ | $m_2$ | action |
|---|---|---|
| 0 | 0 | no action |
| 0 | 1 | add a new data word |
| 1 | 0 | release an existing data word. |

As described in the referenced U.S. Pat. No. 4,022,098, the note detect and assignor 14 will generate a "1" signal on line 87 if a new tone generator is to be assigned. Thus the signal on line 87 can be used for the LSB $m_2$ of the MODE signal. Also as described in the same patent, a signal will appear on line 86 if a tone generator assignment is to be cancelled. Thus the signal on line 86 can be used for the MSB $m_1$ of the MODE signal.

When the note generator remove 110 determines that a previously assigned tone generator is to be released (placed in an unassigned status and encoded into the corresponding assignment data word), the corresponding assignment data word is transferred to the gate 201 as the data signal labeled RELEASE DATA.

As described below, the oldest assignment data word after a sorting operation will appear in the first word position of the data shift register 202 and the newest assignment data word will be stored in the register 205.

The clock 211 generates timing signals which are used to increment the counter 207 and are also used to shift data out of the data shift register. The data shift register and the register 205 act essentially as an end-around shift register in which data read out of one end is reinserted at the other end. As data is read out of the data shift register 202, a new assignment data word is read into the data shift register 202 by the gate 204 in response to the ADD signal on line 241 and the RELEASE signal on line 242.

If no addition or deletion of an assignment data word is to take place, then a ZERO signal is transmitted to both gate 201 and gate 210. The ZERO signal is a data word in which all the bits are zero and can be provided by a signal line placed at the "0" binary state level.

As each assignment data word is read out from the data shift register 202 it is compared with the assignment data word transferred by the gate 201. The comparison is made by means of the comparator 203. An EQUAL signal is generated by the comparator 203 when both of its input assignment data words are equal to each other.

In response to a binary "1" logic state for the EQUAL signal, flip-flop F/F 208 is set so that its output signal Q is placed in the binary logic state "1". Flip-flop F/F 208 is reset each time that the counter 407 returns to its minimaL count state because of its modulo counting implementation. Counter 207 is implemented to count modulo 4 which is the number of tone generators used to illustrate the operation of the event sequencer 115.

Figure 9:
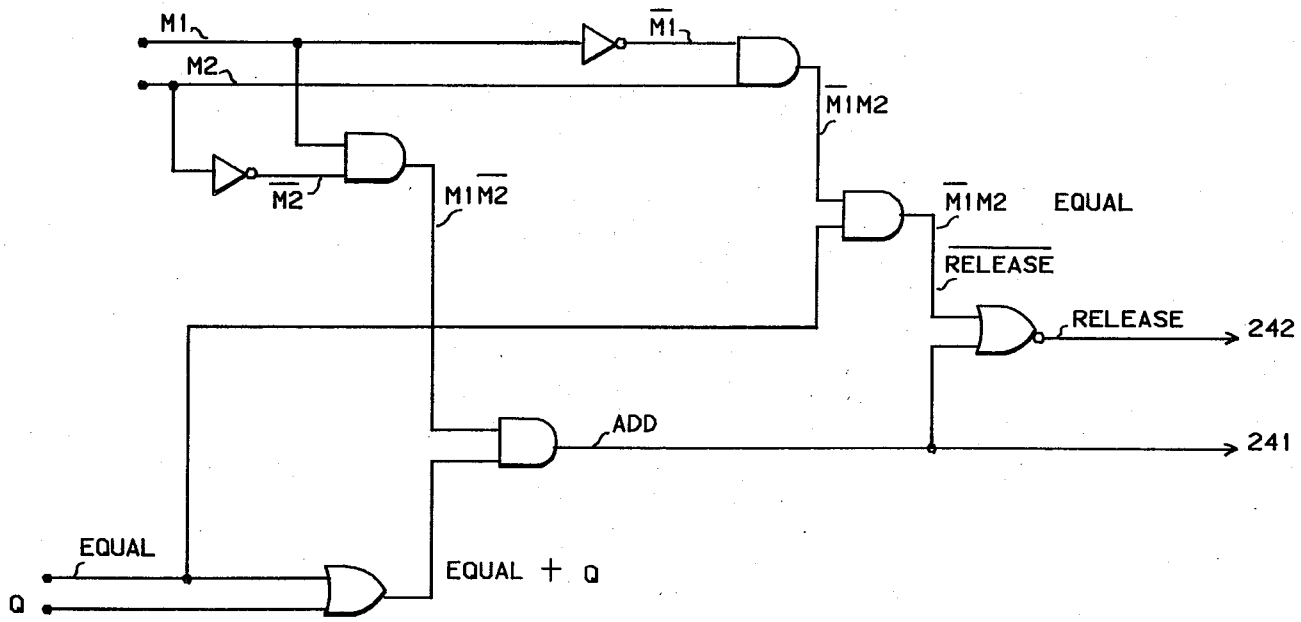
FIG. 9 is a logic diagram of the logic unit 209.

The details of the logic unit 209 are shown in FIG. 9. The logic unit 209 generates the AND signal on line 241 and the RELEASE signal on line 242 in response to the EQUAL signal and the state Q of the flip-flop 208 according to the logic relations:

$$\overline{\text{RELEASE}} = (\overline{m_1} m_2 \text{ EQUAL}) + (m_1 \overline{m_2}(\text{EQUAL} + Q))) \quad \text{Eq. 1}$$

$$\text{ADD} = m_1 \overline{m_2} (\text{EQUAL} + Q) \quad \text{Eq. 2}$$

Table 1 lists the system action for an illustrative example in which the old assignment data words are $N_1$ and $N_2$ and a new assignment data word $N_3$ is to be assigned and placed in storage corresponding to the MODE signal $m_1=0$ and $m_2=1$.

TABLE 1

| Counter 207 State | a | b | Shift Register | | | Register 205 | E | Q |
|---|---|---|---|---|---|---|---|---|
| 1 | 0 | 1 | $N_1$ | $N_2$ | 0 | 0 | 0 | 0 |
| 2 | 0 | 1 | $N_2$ | 0 | 0 | $N_1$ | 0 | 0 |
| 3 | 0 | 0 | 0 | 0 | $N_1$ | $N_2$ | 1 | 0 |
| 4 | 0 | 1 | 0 | $N_1$ | $N_2$ | $N_3$ | 0 | 1 |
| 1 | 0 | 1 | $N_1$ | $N_2$ | $N_3$ | 0 | 0 | 0 |

In the table, the abbreviations used are a=ADD, b=RELEASE, and E=EQUAL. It is noted that at the highest count state of 4 for the counter 207, the new assignment data word $N_3$ is stored in the register 205. Also, each time that the counter 207 is in its minimal count state, the oldest assignment data word appears at the output of the data shift register 202. In this case $N_1$ is the oldest assignment data word.

Table 2 lists the system action starting with the end of the action listed in Table 1 when the assignment data word $N_2$ is to be removed from the event sequencer storage corresponding to the MODE signal $m_1=1$ and $m_2=0$.

TABLE 2

| Counter 207 State | a | b | Shift Register | | | Register 205 | E | Q |
|---|---|---|---|---|---|---|---|---|
| 1 | 0 | 1 | $N_1$ | $N_2$ | $N_3$ | 0 | 0 | 0 |
| 2 | 0 | 1 | $N_2$ | $N_3$ | 0 | $N_1$ | 1 | 0 |
| 3 | 1 | 0 | $N_3$ | 0 | $N_1$ | 0 | 0 | 1 |
| 4 | 1 | 1 | 0 | $N_1$ | $N_3$ | 0 | 0 | 1 |
| 1 | 0 | 1 | $N_1$ | $N_3$ | 0 | 0 | 0 | 0 |

When the counter 207 is in its count state 2, the assignment data word $N_2$ is in the first word position in the data shift register 202. At count state 3, the assignment data word $N_2$ is read out of the data shift register 202 and is found to be equal to the data word transferred by the gate 201 which is destined to be removed from the memory of the event sequencer 115. When the count state 4 of the counter 207 is reached, in response to the ADD="1" signal on line 241, the assignment data word $N_3$ is inserted at the end position of the data shift register by means of the gate 204. Therefore when the new cycle of counter states starts, or at the count state 1, the assignment data words stored in the register is in the correct order of the assignment times. The assignment data word $N_2$ has been removed and the gap in the register store sequence has been closed.

An extension to the number of assignment data words is obtained by simply extending the number of count states for the counter 207 and having a corresponding number of memory storage locations in the data shift register 202.

We claim:

1. In combination with a keyboard musical instrument comprising a keyboard array of a number of keyswitches and having a plurality of tone generators smaller in number than the number of keyswitches in said keyboard array, apparatus for assigning members of said plurality of tone generators to actuated keyswitches in a manner such that a tone generator is always assigned to the latest actuated keyswitch comprising:

a keyswitch state detect means wherein a detect signal is generated in response to each actuated keyswitch in said keyboard array of keyswitches, an encoding means for encoding each said detect signal to generate a detect data word which identifies each said actuated keyswitch corresponding to a generated detect signal, an assignor means responsive to each said detect data word whereby one of said plurality of tone generators is assigned to generate a musical tone associated with a corresponding keyswitch contained in said keyboard array of keyswitches, a tone generator status means whereby a kill signal is generated if all of said plurality of tone generators have been assigned to generate musical tones and an additional data detect word is generated, and a tone generator remove means responsive to said kill signal whereby a detect data word supplied to said assignor means is replaced by said additional data select word.

2. In a musical instrument according to claim 1 wherein said tone generator remove means comprises;

a data detect memory means, an event sequencer means for storing each said detect data word in said data detect memory means in an arrangement ordered in the time sequence in which the keyswitches corresponding to each said data detect word are actuated and wherein said arrangement identifies the oldest data detect signal, and a data substitute means responsive to said kill signal whereby said oldest data detect signal stored in said data detect memory means is replaced by said additional data select word.

3. In combination with a keyboard musical instrument comprising a keyboard array of a number of keyswitches and having a plurality of tone generators smaller in number than the number of keyswitches in said keyboard array, apparatus for assigning members of said plurality of tone generators to actuated keyswitches in a manner such that a tone generator is always assigned to the latest actuated keyswitch comprising;

a keyswitch state detect means wherein a detect signal is generated in response to each actuated keyswitch in said keyboard array of keyswitches, an encoding means for encoding each said detect signal to generate a detect data word which identifies each said actuated keyswitch corresponding to a generated detect signal, an assignor means responsive to each said detect data word whereby one of said plurality of tone generators is assigned to generate a musical tone associated with a corresponding keyswitch contained in said keyboard array of keyswitches, a tone generator counter incremented by each said detect data word, a comparator means responsive to the count state of said tone generator counter whereby if said count state has attained a prespecified maximum value a kill signal is generated in response to an additional data detect word a tone generator remove means responsive to said kill signal whereby a detect data word supplied to said assignor means is replaced by said additional data select word.

4. In combination with a keyboard musical instrument, having a keyboard array of keyswitches, in which a plurality of data words corresponding to the amplitudes of points defining the waveform of a musical tone are computed during each one of a sequence of computation cycles and transferred to a plurality of tone generators smaller in number than the number of keyswitches in said keyboard array, apparatus for assigning members of said plurality of tone generators to actuated keyswitches in a manner such that a tone generator is always assigned to the most recently actuated keyswitch comprising;

a keyswitch state detect means wherein a detect signal is generated in response to each actuated keyswitch in said keyboard array of keyswitches, an encoding means for encoding each said detect signal to generate a detect data word which identifies each said actuated keyswitch corresponding to a generated detect signal, a means for computing whereby said plurality of data words corresponding to the amplitudes of points defining the waveform of a musical tone are computed, a plurality of tone generators each of which produces a musical waveshape in response to said plurality of data words computed by said means for computing, an assignor means responsive to each said detect data word whereby one of said plurality of tone generators is assigned and caused to generate said musical waveshape at a frequency associated with a corresponding keyswitch contained in said keyboard array of keyswitches, a tone generator status means whereby a kill signal is generated if all of said plurality of tone generators have been assigned to generate musical waveforms and an additional data detect word is generated, and a tone generator remove means responsive to said kill signal whereby a detect data word supplied to said assignor means is replaced by said additional data select word.

5. In a musical instrument according to claim 4 wherein said tone generator remove means comprises;

an event sequencer means whereby each of said detect data words are stored in an ordered sequence arranged in the time order in which the keyswitches corresponding to each said detect data word are actuated and wherein said arrangement identifies the oldest data detect signal, and a phase means whereby in response to said kill signal the waveshape produced by one of said plurality of tone generators corresponding to said oldest data detect signal is reduced in amplitude and whereby a done signal is generated when said waveshape has attained a minimum value.

6. In a musical instrument according to claim 5 wherein said tone generator remove means further comprises;

a data remove means responsive to said kill signal whereby said oldest data detect signal is deleted from said stored ordered sequence in said event sequencer means and said additional data detect word is added to said stored ordered sequence in response to said done signal.

7. In combination with a keyboard musical instrument, having a keyboard array of keyswitches, in which a plurality of data words corresponding to the amplitudes of points defining the waveform of a musical tone are computed during each one of a sequence of computation cycles and transferred to a plurality of tone generators smaller in number than the number of keyswitches in said keyboard array, apparatus for assigning members of said plurality of tone generators to actuated keyswitches in a manner such that a tone generator is always assigned to the most recently actuated keyswitch comprising;

a keyswitch state detect means wherein a detect signal is generated in response to each actuated keyswitch in said keyboard array of keyswitches, an encoding means for encoding each said detect signal to generate a detect data word which identifies each said actuated keyswitch corresponding to a generated detect signal, a means for computing whereby said plurality of data words corresponding to the amplitudes of points defining the waveform of a musical tone are computed, a plurality of tone generators each of which produces a musical waveshape in response to said plurality of data words computed by said means for computing, an assignor means responsive to each said detect data word whereby one of said plurality of tone generators is assigned and caused to generate said musical waveshape at a frequency associated with a corresponding keyswitch contained in said keyboard array of keyswitches, a tone generator counter incremented by each said detect data word, a comparator means responsive to the count state of said tone generator counter whereby if said count state has attained a prespecified maximum value then a kill signal is generated in response to said additional data detect word and, a tone generator remove means responsive to said kill signal whereby a detect data word supplied to said assignor means is replaced by said additional data select word.

8. In combination with a keyboard musical instrument, having a keyboard array of keyswitches, in which a plurality of data words corresponding to the amplitudes of points defining the waveform of a musical tone are computed during each one of a sequence of computation cycles and transferred to a plurality of tone generators smaller in number than the number of keyswitches in said keyboard array, apparatus for assigning members of said plurality of tone generators to actuated keyswitches in a manner such that a tone generator is always assigned to the most recently actuated keyswitch comprising;

a keyswitch state detect means wherein a detect signal is generated in response to each actuated keyswitch in said keyboard array of keyswitches, an encoding means for encoding each said detect signal to generate a detect data word which identifies each said actuated keyswitch corresponding to a generated detect signal, a means for computing whereby said plurality of data words corresponding to the amplitudes of points defining the waveform of a musical tone are computed, a plurality of tone generators each of comprises, a note memory means for storing said plurality of data words computed by said means for computing, a slave memory means for storing said plurality of data words, a note clock for providing timing signals at a rate determined by said assignor means, a first memory address means responsive to said timing signals whereby a repetitive sequence of memory address numbers are generated and whereby data words are accessed from said note memory means in response to said memory address numbers, a second memory address means responsive to said sequence of memory address numbers whereby data words are accessed from said slave memory means, an adder for adding said data words read out from said note memory means with said data read out from said slave memory means to create a summed sequence of data words in response to an add signal, a converter means whereby said summed sequence of data words is converted into an audible musical tone, an assignor means responsive to each said detect data word whereby one of said plurality of tone generators is assigned and caused to generate said musical waveshape at a frequency associated with a corresponding keyswitch contained in said keyboard array of keyswitches, a tone generator status means whereby a kill signal is generated if all of said plurality of tone generators have been assigned to generate musical waveforms and an additional data detect word is generated, an event sequencer means whereby each of said detect data words are stored in an ordered sequence arranged in the time order in which the keyswitches corresponding to each said detect data word are actuated and wherein said arrangement identifies the oldest data detect signal, and a phase means whereby in response to said kill signal the waveshape produced by one of said plurality of tone corresponding to said oldest data detect signal is reduced in amplitude and whereby a done signal is generated when said waveshape has attained a minimum value.

9. In a musical instrument according to claim 8 wherein said tone generator remove means further comprises;

a tone generator select means responsive to said kill signal means whereby said add signal is created and provided to one of said plurality of tone generators associated with said oldest data detect signal.

10. In a musical instrument according to claim 8 wherein said second memory address means comprises;

an adder-accumulator means for successively adding a preselected phase constant number to the contents of an accumulator each time one of said sequence of memory address numbers generated by said first memory address means has a preselected value, a phase adder for adding the content of said accumulator in said adder-accumulator means to each of said sequence of memory address numbers to form a phased sequence of memory address numbers, a memory accessing means for reading out said data words from said slave memory means in response to said phase sequence of memory address numbers, and a comparator means responsive to the content of said accumulator in said adder-accumulator whereby said done signal is created when the content of said accumulator attains a predetermined phase cancellation value.

11. In a musical instrument according to claim 10 wherein said predetermined phase cancellation value corresponds to one-half of the number of data points stored in said note memory means.

12. In a musical instrument according to claim 8 wherein said means for computing comprises;

a waveshape memory, a harmonic memory for storing a set of harmonic coefficients, a logic clock for providing logic timing signals, a word counter for counting said logic timing signals modulo the number of said plurality of data words corresponding to the amplitudes of points defining the waveform of a musical tone, a harmonic counter incremented each time said word counter returns to its minimal count state, a computer adder-accumulator means wherein the count state of said harmonic counter is successively added to the content of an accumulator in response to said logic timing signals and wherein the content of said accumulator is initialized to a zero value at the start of each one of said sequence of computation cycles, a sinusoid table storing a set of trigonometric function values, a computer addressing means whereby trigonometric function values are read out of said sinusoid table in response to the content of the accumulator in said computer adder-accumulator means, a harmonic addressing means whereby harmonic coefficients are read out of said harmonic memory in response to the count state of said harmonic counter, a multiplying means whereby a harmonic coefficient read out of said harmonic memory is multiplied by a trigonometric function value read out of said sinusoid table to form a product data, and a summing means whereby said product data is summed with the data stored in said waveshape memory at an address corresponding to the count state of said word counter and the summed value is stored in said waveshape memory thereby creating said points defining the waveform of a musical tone.

* * * * *